United States Patent [19]

Colani

[11] Patent Number: 5,052,567

[45] Date of Patent: Oct. 1, 1991

[54] BOTTLE WITH A GRIPPING RECESS

[75] Inventor: Luigi Colani, Bern, Switzerland

[73] Assignee: Valser St. Petersquelle AG, Speigel, Switzerland

[21] Appl. No.: 482,228

[22] Filed: Feb. 14, 1990

[30] Foreign Application Priority Data

Feb. 17, 1989 [CH] Switzerland ..... 559/89

[51] Int. Cl.[5] ..... B65D 23/10

[52] U.S. Cl. ..... 215/100 A; 220/9.4 A

[58] Field of Search ..... 215/100 R, 1 C, 1 R; 220/94 A; D9/372, 378

[56] References Cited

U.S. PATENT DOCUMENTS

| | | | |
|---|---|---|---|
| D. 196,390 | 9/1963 | McDermott | 215/1 C |
| D. 229,888 | 1/1974 | Schweizer | D9/378 |
| D. 287,935 | 1/1987 | Bech | D9/372 |
| 3,152,710 | 10/1964 | Platte | 215/1 C X |
| 3,760,968 | 9/1973 | Amberg et al. | 215/12.1 |
| 4,155,474 | 5/1979 | Bizzarri | 215/365 |
| 4,749,092 | 6/1988 | Sugiura et al. | 215/1 C |

FOREIGN PATENT DOCUMENTS

| | | |
|---|---|---|
| 055595 | 6/1982 | European Pat. Off. . |
| 198587 | 10/1986 | European Pat. Off. . |
| 2320671 | 11/1974 | Fed. Rep. of Germany . |
| 8804261 | 6/1988 | PCT Int'l Appl. . |
| 490231 | 6/1970 | Switzerland . |
| 502233 | 3/1971 | Switzerland . |
| 540158 | 9/1973 | Switzerland . |
| 622471 | 4/1981 | Switzerland . |
| 651263 | 9/1985 | Switzerland . |

*Primary Examiner*—Sue A. Weaver

*Attorney, Agent, or Firm*—Marshall, O'Toole, Gerstein, Murray & Bicknell

[57] ABSTRACT

The bottle shall render itself to be gripped and held in a specifically safe manner. To this end the area of the bottle to be gripped is ergonomically adjusted to the right hand and to the left hand as well. The bottle includes a heart-shaped niche. The wedge of the human hand between the thumb and index finger can be located in this niche or if grasped at diametrically opposite sides the tips of the fingers can be located in this niche.

6 Claims, 2 Drawing Sheets

BOTTLE WITH A GRIPPING RECESS

BACKGROUND OF THE INVENTION

1. Field of the Invention

The present invention relates to a bottle having an exterior surface which includes a niche allowing a more secure holding of the bottle.

The bottle to be provided shall be able to consist of glass and of a plastic material as well. Furthermore, the bottle to be provided should be suitable for receipt of a beverage and for receipt of a different liquid such as e.g. oil as well. The bottle to be provided shall furthermore be in a position to be of different sizes, i.e. to include various storage volumes, and shall be producible for the common dimensioning of 0.25 liters, 0.33 liters, 0.5 liter or 1 liter.

2. Description of the Prior Art

The provision of bottles having niches allowing a more secure holding thereof have been proposed in various shapes. It is, for instance, known to shape such niche as annular constriction (PCT-application WO 88/04261; published EP-application 00 55 595 CH-PS 490 231; CH-PS 502 233). However, still further shapes of the recess have been proposed, namely rib-shaped recesses (CH-PS 622 471 and 651 263; published EP-application 01 98 587) and circular niches as well (CH-PS 540 158).

Although it is much more difficult to grasp and hold bottles without such niches, the niches which until now have been proposed are still in need of improvement, because they do not correspond sufficiently to the shape of a human hand.

SUMMARY OF THE INVENTION

Hence, it is a general object of the invention to improve a bottle to be provided in regard to the above situation, whereby it also shall be possible that the bottle can be produced at responsible expenditures and such that the bottle still can be handled in common filling apparatuses (rinsing, filling, labelling).

A further object is to provide a bottle having such a niche which can be held and manipulated conveniently (location of the center of gravity when emptying the bottle).

Still a further object is to provide a bottle in which the niche comprises a substantially cardioid shape arranged such that the symbolic tip of the heart faces the bottom of the bottle.

BRIEF DESCRIPTION OF THE DRAWINGS

The invention will be better understood and objects other than those set forth above will become apparent when consideration is given to the following detailed description thereof. Such description makes reference to the annexed drawings, wherein.

DESCRIPTION OF THE PREFERRED EMBODIMENT

Figure 1:
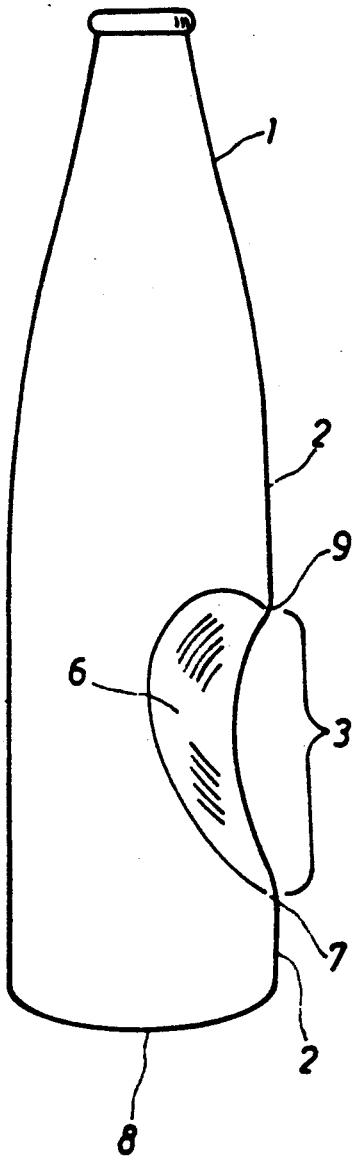
FIG. 1 is a side view of a bottle in accordance with the invention.
Figure 2:
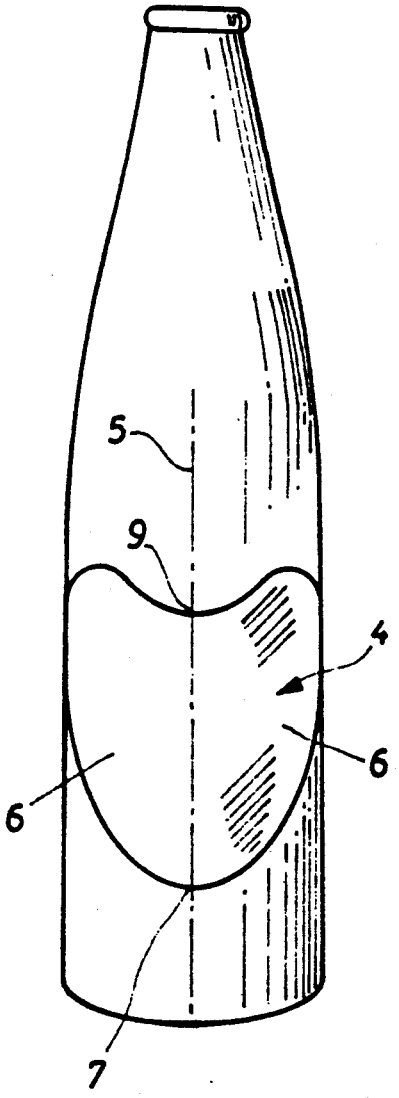
FIG. 2 is a front view of the bottle.
Figure 3:
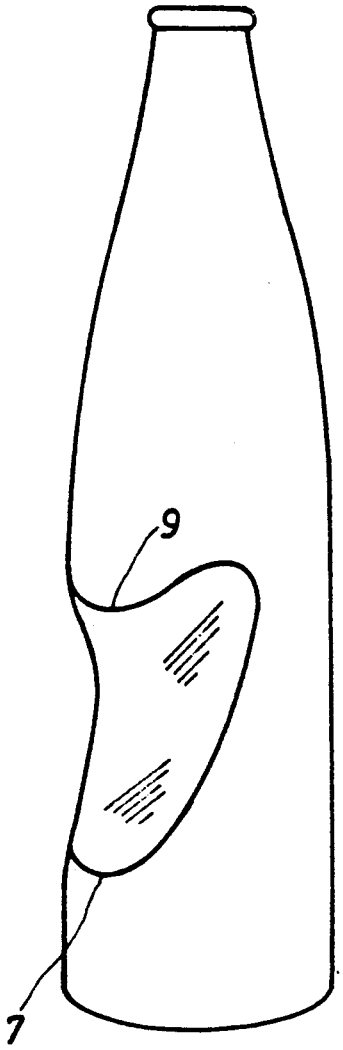
FIG. 3 is a view of the bottle seen halfway from the side.

The bottle has a tapered exterior surface 1 and a cylindric exterior surface 2. The cylindric exterior surface 2 comprises a cardioid, i.e. heart-like shape extending along the height 3 thereof. This cardioid shape of the niche 4 is in front view in accordance with FIG. 2 symmetrical relative to the longitudinal axis 5 of the bottle. In a side view according to FIG. 1 the cardioid shape of the niche 4 is symmetrically split into two halves 6 of the cardioid shape, whereby these two cardioid shaped halves 6 are located in registry behind each other. The symbolic tip 7 of the heart (i.e. the cardioid or heart, respectively, shape must not end at a sharp edge) is directed to the bottom 8 of the bottle. The upper wedge section 9 of the heart shape and the lower tip 7 of the heart shape are therefore located on the longitudinal axis 5 of the bottle.

As can be seen clearly from the drawings, the heart-shaped niche 4 is located within the lower half of the height of the bottle.

Because this cardioid or heart-shaped niche fits ergonomically the human hand, it is quite obvious that a compromise for the dimensions of this niche must be arrived at, because the size of the human hand differs considerably between that of a child and that of a grownup. Accordingly, the dimension of the niche is selected in dimensions remaining substantially the same, independently if the bottle has a storage volume of 0.33 liters or 1 liter.

If the bottle is intended for receipt of a beverage, it will commonly consist of glass. If the bottle, however, is intended for receipt of e.g. oil, the bottle can also be produced from a plastic material. Because the transition from the heart-shaped niche 4 to the adjacent cylindrical exterior surface is not sharp edged, the stability of a bottle made of a plastic material will not be detrimentally influenced by the cardioid shaped niche 4; in contrast thereto, by such reducing of the circumferential surface in the area of the height 3 it even may be increased.

Figure 4:
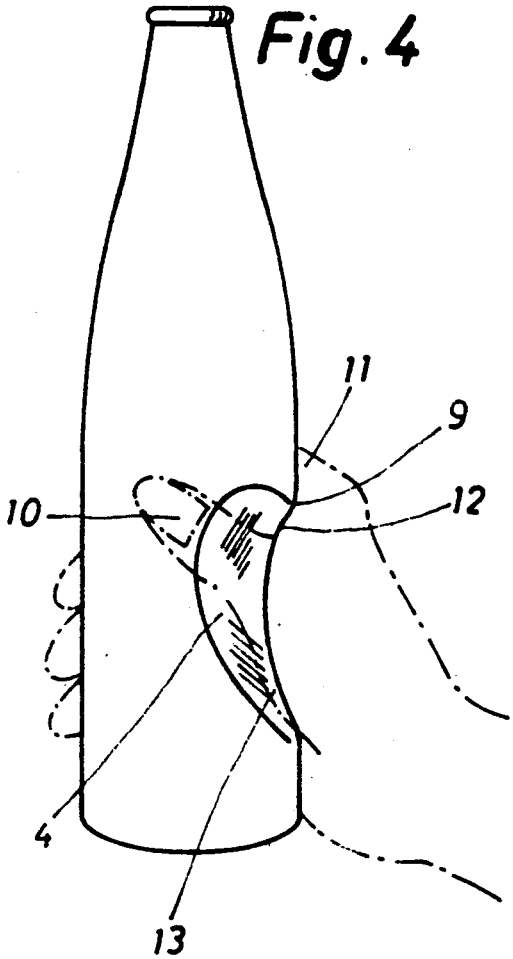
FIG. 4 is a view of the bottle shown in FIG. 1 together with a first position of a hand holding the bottle.
Figure 5:
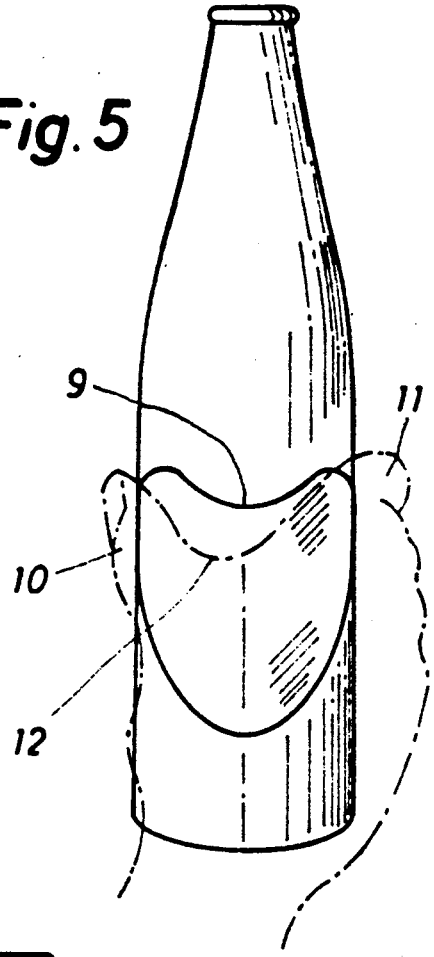
FIG. 5 illustrates the same first position of the hand in a front view of the bottle according to FIG. 2.

FIGS. 4 and 5 illustrate a first position of a hand holding this bottle. The V-shaped hand wedge area 12 located between the thumb 10 and the index finger 11 lies hereby adaptably at the wedge section 9 of the heart-shaped niche 4. Hereby the thumb 10 and the ball 13 of the thumb may lie substantially within the one half 6 of the heart-shape. Furthermore, a part of the index finger and its ball lie in the other half 6 of the heart shape.

Figure 6:
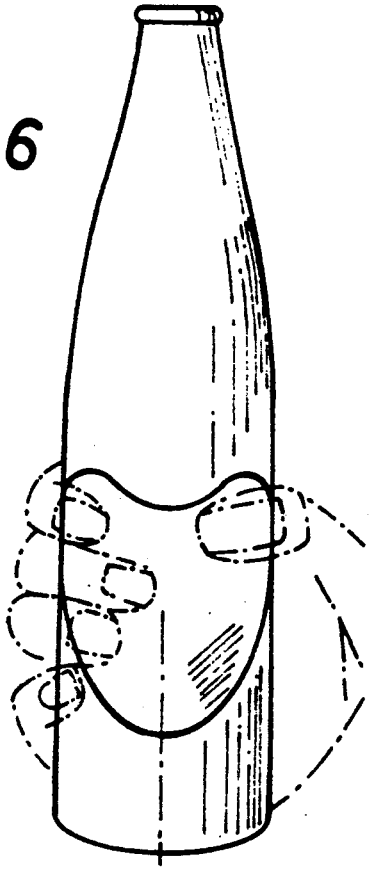
FIG. 6 is a view of a second position of the hand together with the front view of the bottle in accordance with FIGS. 2 and 5.

FIG. 6 depicts a second position of the hand holding the bottle, whereby this position is diametrically opposite to the previously mentioned first position. Here the fingers of the hand holding the bottle can lie in the cardioid niche 4 and accordingly may grip safely behind the bottle in case the hand and the bottle have corresponding dimensions relative to each other. In case of a one-liter bottle one will choose only the first position of the hand as illustrated in FIGS. 4 and 5.

The respective height position of the heart-shaped niche 4 relative to the bottom 8 of the bottle is selected such that when the bottle is held by the human hand in a horizontal state, the filled bottle is in an equilibrium.

While there is shown and described the present preferred embodiment of the invention, it is to be distinctly understood that the invention is not limited thereto, but may be otherwise variously embodied and practiced within the scope of the following claims.

I claim:

1. A bottle having an exterior surface which includes a niche shaped to conform to the hand allowing a more secure holding of the bottle, said niche comprising a symmetrically split, substantially cardioid shape defined by bilaterally formed cavities defining wall portions, which meet along a plane defined by longitudinal axis of said bottle and form a lower tip, whereby in side view, the two halves of the symmetrically split cardioid shape are located in registry behind each other along said plane and whereby the cardioid shape is arranged such that the lowered tip of the heart faces the bottom of the bottle.

2. The bottle of claim 1, in which the cardioid shaped niche is located within the lower half of the height of the bottle.

3. The bottle of claim 1, in which the cardioid shaped recess is located at a cylindrical portion of the bottle.

4. The bottle of claim 1, wherein said bottle consists of glass.

5. The bottle of claim 1, wherein said bottle is characterized by a storage volume selected by the group consisting of 0.25 liter, 0.33 liter, 0.5 liter and 1 liter.

6. A container intended for receipt of a beverage, comprising a bottle according to claim 1.

* * * * *

UNITED STATES PATENT AND TRADEMARK OFFICE

CERTIFICATE OF CORRECTION

PATENT NO. : 5,052,567

DATED : October 1, 1991

INVENTOR(S) : Colani

It is certified that error appears in the above-indentified patent and that said Letters Patent is hereby corrected as shown below:

Column 4, line 1, "lowered" should be --lower--.

Signed and Sealed this

Seventeenth Day of May, 1994

Bruce Lehman

*Attest:*

BRUCE LEHMAN

*Attesting Officer*

*Commissioner of Patents and Trademarks*